United States Patent [19]

Hammerel

[11] 4,158,644

[45] Jun. 19, 1979

[54] CLEANER AND GREASE EMULSIFIER

[75] Inventor: Richard J. Hammerel, Downers Grove, Ill.

[73] Assignee: Kewanee Industries, Inc., Bryn Mawr, Pa.

[21] Appl. No.: 887,785

[22] Filed: Mar. 17, 1978

[51] Int. Cl.[2] ..... C11D 1/90; C11D 1/62; C11D 1/835; C11D 7/32

[52] U.S. Cl. ..... 252/547; 252/546; 252/527; 252/528; 252/173; 252/321; 252/358; 252/DIG. 1; 252/DIG. 8; 252/DIG. 10; 252/DIG. 14

[58] Field of Search ..... 252/546, 547, 527, 528, 252/173, 321, 358, DIG. 1, DIG. 8, DIG. 10, DIG. 14

[56] References Cited

U.S. PATENT DOCUMENTS

| | | | |
|---|---|---|---|
| 3,849,348 | 11/1974 | Hewitt | 252/547 |
| 4,065,409 | 12/1977 | Flanagan | 252/DIG. 1 |

*Primary Examiner*—Mayer Weinblatt
*Attorney, Agent, or Firm*—Arthur A. Jacobs

[57] ABSTRACT

Hard surface detergent compositions comprising an aqueous composition of (a) a non-ionic surfactant, (b) a quaternary ammonium salt, and (c), a betaine.

5 Claims, No Drawings

CLEANER AND GREASE EMULSIFIER

This invention relates to hard-surface detergents. More particularly, this invention relates to detergent compositions which are especially effective in degreasing hard surfaces. It has been discovered that an aqueous solution containing three surfactant solutes in certain ratios, is extremely effective in separating from hard surface fats and greases such as petroleum greases, crankcase oil, greases derived from or containing animal or vegetable fats, hardened cooking oil, and the like.

It has, furthermore, been discovered, that if these three components are present outside the relatively narrow range of ratios, or if only two components are present in the composition, the effectiveness of the composition is reduced considerably. The composition is an effective degreaser of surfaces such as tile, glass, metal, plastic, linoleum, painted surfaces and the like.

Although the mechanism by which the composition performs is not a part of this invention, it appears that it is effective because it is a very rapid emulifier of grease. It is much more effective for degreasing hard surfaces than the usual aqueous dispersions of industrial solvents such as Butyl Cellosolve. This discovery cannot be anticipated by present knowledge of the art.

In accordance with the present invention, an improved hard-surface detergent composition having the properties and uses described above, may be prepared by making an aqueous solution which contains three solutes, as follows:

(A) A non-ionic surfactant from the class of surfactants known as alkylphenol polyglycolether condensate. The compounds of choice are either (1) derived from nonylphenol, and have an average of 9.5 moles of ethylene oxide per mole of nonylphenol in the condensate, or (2) derived from octylphenol and have an average of 9–13 moles of ethylene oxide per mole of octyl phenol in the condensate. Such non-ionic surfactants are will known in industry, and are available commercially, for example, from ONYX CHEMICAL CO., 190 Warren Street, Jersey City, N.J. 07302 under the trade name of "NEUTRONYX".

(B) A quaternary ammonium salt, or a mixture of quaternary ammonium salts selected from alkyl dimethyl benzyl ammonium chloride, and alkyl dimethyl ethylbenzyl ammonium chloride, the alkyl group being a normal alkyl chain of from 12 to 18 carbon atoms. Such compounds have the general formula

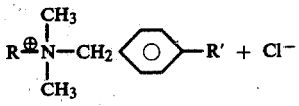

in which R is a normal alkyl chain of between 12 and 18 carbon atoms, and R′ is either hydrogen or the ethyl radical.

Such quarternary ammonium compounds are well know in industry, and are available commercially, for example, from ONYX CHEMICAL COMPANY under the Trade name "BTC 2125" which is a mixture of the benzyl and ethylbenzyl quaternary ammonium chlorides.

(C) A betaine of general formula

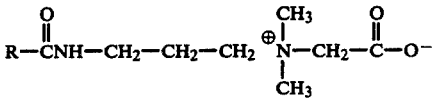

in which

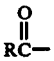

represents the acyl groups found in coconut fatty acids. Such betaines are well known in industry and are, for example, available commercially from HAAG LABORATORIES, 1400 South Seely Ave., Chicago, Ill. 60406, under the trade name "SURCO COCO BETAINE".

It has been found that the mixture of surfactants functions best as a degreasing agent when the non-ionic, the cationic and betaine surfactants are present in the ratio of about 4.5:3.0:1.0 respectively. The latitude of this ratio is about ±10% of each component for maximum effect. Therefore, a more proper ratio of anionic to cationic to betaine would be 4.15 to 4.95 parts of non-ionic: 2.7 to 3.3 parts of cationic: 0.9 to 1.1 parts betaine. The total concentration of all surfactants in the mixture described above must be chosen to meet the requirement of total or almost total grease removal. The maximum total concentration of surfactants tested on heavy, difficulty-removable greases was 4.0% solids in aqueous solution. This concentration seldom failed in removing grease from even the most stubborn cases, when ordinary surfactant mixtures failed. However, complete or almost complete degreasing also occured when the 4% total surfactant solution was diluted 1:20. In other words, total surfactant concentration of about 0.2% is sufficient in most cases, provided the three surfactants are present in the proper ratio.

When the grease soil was not excessively heavy, total, or almost total degreasing occurred when the 4.0% solution was diluted 1:40. In other words, total surfactant concentration of about 0.1% was sufficient for medium or light grease soils, provided the three surfactants were present in proper ratio.

Following are the formulas for several mixtures which were tested and found to be successful.

| FORMULA I | |
|---|---|
| NEUTRONYX 656 (100% active) | 1.80% |
| BTC 2125 M (80% active) | 1.40% |
| SURCO COCO BETAINE (30% active) | 1.30% |
| WATER | 95.50% |
| Total solids 3.31% | 100.00% |

| FORMULA II | |
|---|---|
| NEUTRONYX 656 (100% active) | 2.00% |
| BTC 2125 M (80% active) | 1.50% |
| SURCO COCO BETAINE (30% active) | 1.33% |
| WATER | 95.17% |
| Total solids 4.0% | 100.00% |

| FORMULA III | |
|---|---|
| NEUTRONYX 656 (100% active) | 2.00% |
| BTC 2125 M (80% active) | 1.40% |
| SURCO COCO BETAINE (30% active) | 1.40% |
| WATER | 95.20% |
| Total solids 3.64% | 100.00% |

Although these mixtures functioned as degreasers in neutral solution, at pH about 7, they perform even better when alkaline builders are added. Ordinarily, about 4% to 8% alkaline builders caused the aqueous solution to acquire a pH of about 12, at which degreasing appeared to be optimum. Among the alkalais added with good effect were sodium metasilicate, sodium or potassium tripolyphosphate, sodium hydroxide, sodium carbonate, and the like.

Following are some representative compositions.

| FORMULA IV | |
|---|---|
| SODIUM METASILICATE PENTAHYDRATE | 4.8% |
| SODIUM TRIPOLYPHOSPHATE | 1.2% |
| NEUTRONYX 656 (100% active) | 1.8% |
| BTC-2125 (80% active) | 1.4% |
| SURCO COCO BETAINE (30% active) | 1.3% |
| WATER | 89.5% |

| FORMULA V | |
|---|---|
| SODIUM HYDROXIDE 50% | 2.5% |
| SODIUM CARBONATE | 1.5% |
| SODIUM TRIPOLYPHOSPHATE | 1.0% |
| NEUTRONYX 656 (100% active) | 2.00% |
| BTC-2125 M (80% active) | 1.50% |
| SURCO COCO BETAINE (30% active) | 1.33% |
| WATER | 89.17% |

| FORMULA VI | |
|---|---|
| SODIUM BICARBONATE | 5.0% |
| SODIUM HYDROXIDE 50% | 2.0% |
| SODIUM TRIPOLYPHOSPHATE | 1.0% |
| NEUTRONYX 656 (100% active) | 2.0% |
| BTC 2125 M (80% active) | 1.4% |
| SURCO COCO BETAINE (30% active) | 1.4% |
| WATER | 87.2% |

Solutions made in compliance with FORMULAS I, II, III, IV, V, VI were effective degreasers against heavy grease deposits, even at dilutions of 1:20 with water. Against normal soils, they were effective even at dilutions of 1:40 with water.

Since the solutions made according to formulas I, II, III, IV, V, VI are copious foamers, even when diluted to 1:40 with water, it is within the scope of this invention to add low concentrations of anti-foaming agents when large volumes of foam reduces the effectiveness of the solution as a degreasing agent. The anti-foaming agent of choice is the silicone based methyl polysiloxane, and concentrations as low as 0.005% to 0.01% in the concentrated solutions exemplified by formulas I, II, III, IV, V, and VI are effective anti-foamers, eveh when diluted to 1:40 in water.

Other anti-foaming agents such as higher alcohols, higher polyols, and glycerides may also be used.

When one of the surfactants of the combination is omitted from the formula, or when it is replaced by an organic industrial solvent such as Butyl Cellosolve, the mixture, whether in concentrated form, or diluted 1:20 or 1:40 with water, is considerably less effective as a degreasing agent. For example, solutions of formula VII, VIII, were not very effective, either in concentrated form or in dilution of 1:20 or 1:40 against most of the soils toward which formulas I, II, III, IV, V, VI were very effective.

| FORMULA VII | |
|---|---|
| SODIUM META-SILICATE PENTAHYDRATE | 4.8% |
| SODIUM TRIPOLYPHOSPHATE | 1.2% |
| BUTYL CELLOSOLVE | 3.0% |
| BTC 2125 M (80% active) | 1.4% |

-continued

| | |
|---|---|
| SURCO COCO BETAINE (30% active) | 1.3% |
| WATER | 88.3% |

| FORMULA VIII | |
|---|---|
| SODIUM META-SILICATE PENTAHYDRATE | 4.8% |
| SODIUM TRIPOLYPHOSPHATE | 1.2% |
| NEUTRONYX 656 (100% active) | 1.8% |
| BUTYL CELLOSOLVE | 3.0% |
| SURCO COCO BETAINE (30% active) | 1.3% |
| WATER | 87.9% |

| FORMULA IX | |
|---|---|
| SODIUM META-SILICATE PENTAHYDRATE | 4.8% |
| SODIUM TRIPOLYPHOSPHATE | 1.2% |
| NEUTRONYX (100% active) | 1.8% |
| BTC 2125 (80% active) | 1.4% |
| BUTYL CELLOSOLVE | 3.0% |
| WATER | 87.8% |

When one of the surfactants in Formulas I, II, III, IV, V, VI was replaced by an equal weight of either one of the other two surfactants, the solutions lost much of their effectiveness as degreasing agents. Therefore, it is obvious that any loss of effectiveness is not due to a dimunition of surfactant concentration. It is also obvious that an excess of one surfactant will not noticeably improve the performance of the mixture.

It must be the unpredictable effectiveness of the ratio of the three surfactants which accounts for the unusual degreasing properties of the mixture.

The invention claimed is:

1. An aqueous hard surface detergent composition consisting essentially of (1) a polyglycol ether condensate of a member of the group consisting of nonyl phenol having an average of about 9.5 moles of ethylene oxide per mole of condensate, octyl phenol having from 9 to 13 moles of ethylene oxide per mole of condensate, and mixtures thereof; (2) a quaternary ammonium salt selected from the group consisting of alkyl dimethyl benzyl ammonium chloride, alkyl dimethyl ethylbenzyl ammonium chloride in which the alkyl chains have from 12 to 18 carbon atoms, and mixtures thereof, and (3) a member selected from the group consisting of acylamidopropyldimethylamino acetic acid and its anion, the acyl portion of the acylamidopropyl chain being derived from the fatty acids of coconut oil; the ratio of the respective components (1), (2) and (3) being about 4.5:3:1 by weight, and total concentration of components (1), (2) and (3) being between 0.1 and 4% by weight.

2. The composition of claim 1 wherein the composition has a pH of about 7 to 12.

3. The composition of claim 1 wherein about 4 to 8% by weight of alkaline builders are present.

4. A method of degreasing hard surfaces which comprises applying to such surfaces an effective amount, sufficient to emulsify grease adhering to said surfaces and thereby degrease said surfaces, of an aqueous detergent composition consisting essentially of (1) a polyglycol ether condensate of a member of the group consisting of nonyl phenol having an average of about 9.5 moles of ethylene oxide per mole of condensate, octyl phenol having from 9 to 13 moles of ethylene oxide per mole of condensate, and mixtures thereof; (2) a quaternary ammonium salt selected from the group consisting of alkyl dimethyl benzyl ammonium chloride, alkyl dimethyl ethylbenzyl ammonium chloride in which the alkyl chains have from 12 to 18 carbon atoms, and mixtures thereof, and (3) a member selected from the group consisting of acylamidopropyldimethylamino acetic acid and its anion, the acyl portion of the acylamidopropyl chain being derived from the fatty acids of coconut oil; the ratio of the respective components (1), (2) and (3) being about 4.5:3:1 by weight, and total concentration of components (1), (2) and (3) being between 0.1 and 4% by weight.

5. The method of claim 4 wherein the composition also includes about 4 to 8% by weight of alkaline builders.

* * * * *